US010322322B2

(12) United States Patent
Frame et al.

(10) Patent No.: US 10,322,322 B2
(45) Date of Patent: Jun. 18, 2019

(54) GOLF CLUB HAVING IMPROVED SOUND PROPERTIES

(71) Applicant: Acushnet Company, Fairhaven, MA (US)

(72) Inventors: Nick Frame, Vista, CA (US); Richard L. Cleghorn, Oceanside, CA (US)

(73) Assignee: ACUSHNET COMPANY, Fairhaven, MA (US)

( * ) Notice: Subject to any disclaimer, the term of this patent is extended or adjusted under 35 U.S.C. 154(b) by 281 days.

(21) Appl. No.: 14/963,059

(22) Filed: Dec. 8, 2015

(65) Prior Publication Data

US 2017/0157472 A1 Jun. 8, 2017

(51) Int. Cl.

| | |
|---|---|
| ***A63B 53/04*** | (2015.01) |
| ***A63B 60/54*** | (2015.01) |
| *A63B 60/00* | (2015.01) |

(52) U.S. Cl.

CPC ..... *A63B 53/0466* (2013.01); *A63B 60/54* (2015.10); *A63B 2053/0433* (2013.01); *A63B 2053/0437* (2013.01); *A63B 2060/002* (2015.10); *A63B 2209/00* (2013.01)

(58) Field of Classification Search

CPC ..... A63B 53/04; A63B 2063/0433; A63B 2053/0437; A63B 2053/0466

USPC ..... 473/324, 332, 333, 345, 349

See application file for complete search history.

(56) References Cited

U.S. PATENT DOCUMENTS

| | | | | |
|---|---|---|---|---|
| 1,854,548 | A * | 4/1932 | Hunt | A63B 53/04 473/329 |
| 3,556,532 | A * | 1/1971 | Ballmer | A63B 53/04 473/332 |
| 6,027,416 | A * | 2/2000 | Schmidt | A63B 53/04 473/305 |
| 7,470,201 | B2 * | 12/2008 | Nakahara | A63B 53/0466 473/345 |
| 7,582,024 | B2 * | 9/2009 | Shear | A63B 53/0466 473/329 |
| 7,914,393 | B2 | 3/2011 | Hirsch et al. | |
| 9,320,949 | B2 * | 4/2016 | Golden | A63B 53/06 |
| 9,403,070 | B2 * | 8/2016 | Stokke | A63B 53/0466 |
| 9,421,434 | B2 * | 8/2016 | Takagi | A63B 53/0466 |
| 2006/0052177 | A1 * | 3/2006 | Nakahara | A63B 53/0466 473/329 |

* cited by examiner

*Primary Examiner* — William M Pierce

(57) ABSTRACT

A golf club head has a stranded structure such as a cantilevered strand or a beam strand. The stranded structure causes changes in acoustic properties from that of a standard golf club. A gap or through-hole around the stranded structure may be filled with a vibration dampening material, such as flexible polymer, to further adjust the acoustic properties of the golf club. Vibration frequency regions in a golf club may be modified by incorporating stranded structures in the vibration frequency regions.

10 Claims, 13 Drawing Sheets

GOLF CLUB HAVING IMPROVED SOUND PROPERTIES

BACKGROUND

When a golf club head strikes a golf ball, it emits sound due the vibration of the components of the golf club head. When a driver or fairway metal strikes a golf ball, multiple components vibrate and produce sound at different frequencies. In some instances, the different components of the golf club head, such as the crown and the sole, vibrate with different frequencies that produce a combined sound that is heard by the user. In some golf clubs, multiple regions within each of the components may also vibrate at different frequencies, which all contribute to the combined sound that is heard by the user. The emission of sound is particularly noticeable when drivers or fairway metals strike a golf ball, and may influence a golfer's opinion of the golf club. In fact, some golf clubs available today produce sound characteristics that are displeasing to the user.

SUMMARY

In one aspect, the technology relates to a golf club head having: a crown; a club face connected to the crown; and a sole connected to and disposed opposite the crown, wherein the crown, the club face, and the sole at least partially define an interior void, and wherein at least one of the crown and the sole define at least one stranded structure, wherein an unsupported section of the at least one stranded structure is separated from at least one of the crown and the sole by a through-hole, and wherein the through-hole is filled with a vibration dampening material. In an embodiment, the stranded structure includes at least one of a cantilevered structure and a beam structure. In another embodiment, the vibration dampening material includes at least one of: an acrylic epoxy, a urethane, a polyurethane, an ionomer, an elastomer, a silicone, and a rubber. In yet another embodiment, at least one stranded structure is cantilevered and substantially spiral. In still another embodiment, the at least one stranded structure has a length to width ratio of at least ten.

In another embodiment of the above aspect, the vibration dampening material alters at least one of an inherent vibration frequency and an inherent vibration duration of the golf club head present in an absence of the at least one stranded structure. In an embodiment, a surface area of the at least one stranded structure is more than about 10% of the at least one of the crown and the sole. In another embodiment, the sole includes a plurality of inherent vibration frequency regions, each having a known inherent frequency. In yet another embodiment, the vibration dampening material is disposed so as to alter a frequency of at least one of the plurality of the inherent vibration frequency regions from the known inherent frequency to a frequency of less than about 200 Hz.

In another aspect, the technology relates to a golf club head having: a metal club face; a metal crown connected to the club face; a metal sole connected to the club face, wherein the metal club face, the metal crown, and the metal sole at least partially define an interior void; and a polymer plug disposed in a through-hole defined by at least one of the metal crown and the metal sole, wherein a surface area of the polymer plug is greater than or equal to about 5% of the at least one of the metal crown and the metal sole, and the polymer plug has a durometer hardness value within a range of about A20 to about D90. In an embodiment, an external surface of the polymer plug is contoured to substantially match a contour of an exterior surface defined by at least one of the metal crown and the metal sole. In another embodiment, the polymer plug is made from a vibration dampening material having at least one of: an acrylic epoxy, a urethane, a polyurethane, an ionomer, an elastomer, a silicone, and a rubber. In yet another embodiment, the through hole is substantially spiral and is defined by a cantilevered strand of a metal material that is substantially spiral. In still another embodiment, the polymer plug alters at least one of an inherent vibration frequency and an inherent vibration duration of the golf club head present in an absence of the through hole.

In another embodiment of the above aspect, at least one of the metal crown and the metal sole comprises a plurality of inherent vibration frequency regions, each having a known inherent frequency. In an embodiment, the polymer plug is disposed at a predetermined inherent vibration frequency region having a predetermined inherent frequency. In another embodiment, the polymer plug is disposed so as to alter a frequency of the predetermined inherent vibration frequency region from the predetermined inherent frequency to a frequency of less than about 200 Hz. In yet another embodiment, at least one additional polymer plug disposed in at least one additional through hole is defined by at least one of the metal crown and the metal sole.

In another aspect, the technology relates to a method for manufacturing a golf club, the method including: forming a golf club head having a face connected to a sole and a crown so as to define an interior void; removing material from at least one of the crown and the sole so as to form a stranded structure, wherein an unsupported section of the stranded structure is separated from the at least one of the crown and the sole by a through-hole; and filling the through-hole with a vibration dampening material. In an embodiment, the method further includes identifying a portion of at least one of the crown and the sole that emits a sound frequency between 300 Hz to 3 kHz when the golf club head strikes a golf ball, and wherein the removing operation removes a part of the identified portion.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

Non-limiting and non-exhaustive examples are described with reference to the following Figures.

DETAILED DESCRIPTION

The technologies described herein contemplate a golf club head that utilizes a sole or a crown having a cantilevered strand or a beam strand formed therein. In addition, a gap around the unsupported portion of a cantilevered strand or a beam strand in the sole or the crown may be filled with a polymer that has a stiffness that is much less than that of the (typically metal or rigid composite) crown or sole material. The polymer absorbs the vibrations in the golf club head, thus altering the sound emitted from the club head. By manufacturing the crown or sole, or in some examples both the crown and the sole, to have at least one stranded structure, such as a cantilevered strand or beam strand, the sound properties of the club head may be altered from that of a golf club head without the stranded structure. For instance, a cantilevered strand is a stranded structure supported at one end, whereas a beam strand is a stranded structure supported on at least two ends. In a particular example, portions of the sole or crown that produce an undesirable inherent sound frequency may have that undesirable frequency reduced or otherwise altered by forming a cantilevered strand or beam strand in that portion of the sole or crown. The gap disposed around the stranded structure may then be filled with a polymer so as to reduce the sound frequency associated with that portion of the crown or the sole to a frequency that is difficult to be heard by the human ear. Thus, by controlling the size and location of the strands, the components of the club head can be "tuned" to produce a more desirable sound.

Prior attempts to alter the sound of a club head when it struck a golf ball primarily focused on adding material to the club head to raise the frequency of certain components of the golf club. By way of example, stiffening ribs would be added to the sole of a club head to stiffen the sole, which would result in an increase in the frequency emitted compared to a golf club without the ribs. The present technology takes a contrasting approach to alter the sound emitted from a club head by removing material from the golf club head to add additional flexibility to the components of the club head. The resulting effect is that rather than increasing the frequency of the sound emitted by the component, the frequency of the sound emitted by the component may be reduced or eliminated.

Figure 1A:
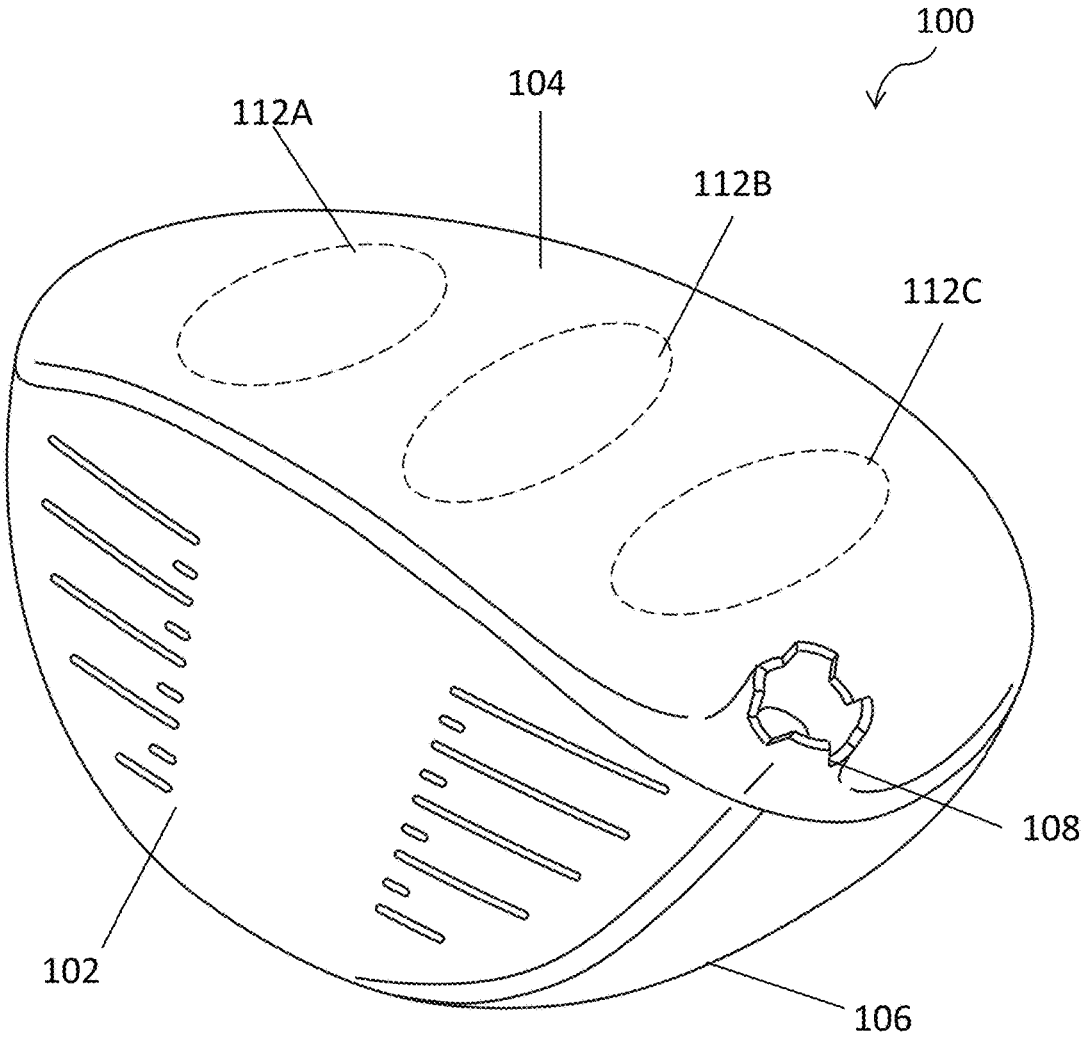
FIG. 1A depicts a perspective view of a golf club head.
Figure 1B:
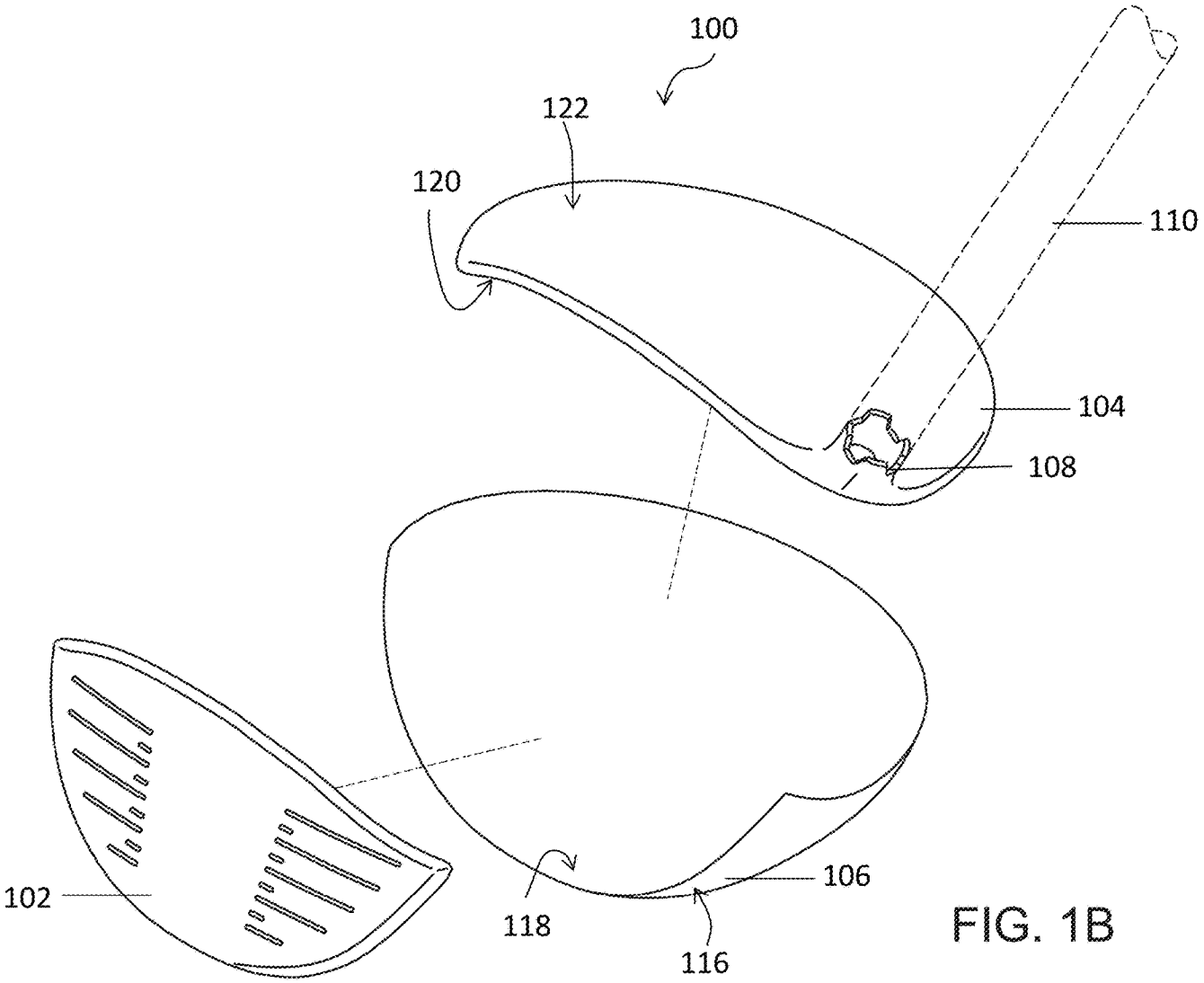
FIG. 1B depicts an exploded perspective view of the golf club head of FIG. 1A.
Figure 1C:
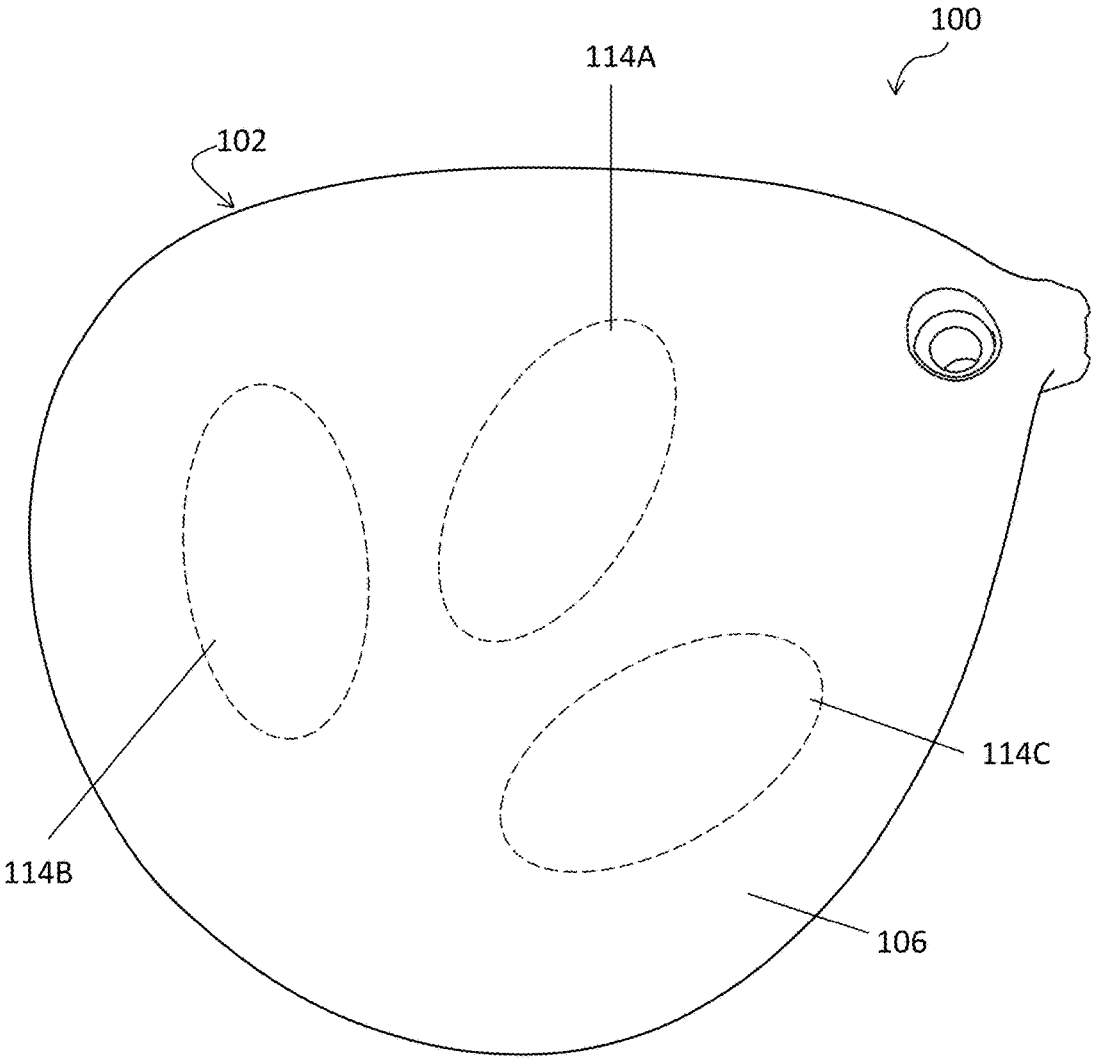
FIG. 1C depicts a bottom view of the golf club head of FIG. 1A.

FIGS. 1A-1C depict an example of a golf club head 100 and are described simultaneously. The golf club head 100 includes a club face 102, a crown 104, and a sole 106. The club face 102 may comprise any type of club face utilized in the manufacture of golf clubs, such as a face insert, a face cup, an L-cup, a C-cup, or other construction, without departing from the scope and content of the present disclosure. The crown 104 forms the top portion of the club head 100 and is generally made of a rigid material, such as a metal or a rigid composite. The crown 104 has an outer crown surface 122 and an inner crown surface 120. The sole 106 forms the bottom, or underside, portion of the golf club head 100 and is generally also made of a rigid material, such as a metal or a rigid composite. The sole 106 has an outer sole surface 116 and an inner sole surface 118. The crown 104, sole 106, and club face 102, when fitted together, define an interior void within the golf club head 100. The outer crown surface 122 and the outer sole surface 116 may also be coated with additional substances, such as paints, coatings or films. In addition, further structures or materials may also be attached to the outer crown surface 122 and the outer sole surface 116. Similarly, the inner crown surface 120 and the inner sole surface 118 may also be coated with additional substances or coatings. The inner crown surface 120 and the inner sole surface 118 may also have structural materials, such as ribs or other components, attached to the surfaces. The golf club head 100 may also include a hosel 108 having components for attaching a shaft 110, as is well-understood by those having skill in the art. While the figures generally depict a driver, the technology discussed herein is equally applicable to fairway metals, hybrid clubs, and other similar clubs containing both a crown and a sole.

As discussed above, when the golf club head strikes a golf ball, a sound is emitted. The sound may be characterized as having multiple vibration mode frequencies. The emitted sound is due to vibration of the components of the golf club 100 or regions thereof. Each component, such as the sole 106 and the crown 104, may have one vibration frequency across the entire component, or the component may have multiple vibration frequency regions that each vibrate at a different frequency. Example vibration frequency regions are identified in FIGS. 1A-1C as crown vibration frequency regions 112A-C and sole vibration frequency regions 114A-C. In general, a vibration frequency region is a region of a golf club component that displays or produces a sound that may or may not be desirable upon the golf club 100 striking a golf ball. The vibration frequency regions 112A-C and 114A-C are depicted schematically and discretely, for clarity. In examples, certain vibration frequency regions may overlap and some vibration frequency regions may have a larger area than others. Additionally, some vibration frequency regions will produce sound frequencies that are not undesirable or are even very desirable. Various frequency regions that produce both desirable and undesirable inherent vibration frequency regions and their respective vibration frequencies may be identified through acoustic and optical techniques, such as measurements made with a laser vibrometer and modal analysis based on simulations. Each vibration frequency region vibrates at a particular frequency range and for a particular duration upon the golf club head 100 striking a golf ball. In some instances, each vibration frequency region contributes to a different vibration mode frequency in the composite sound emitted from the golf club head 100 during play. Some vibration modes will result from contributions of multiple vibration frequency regions. Accordingly, vibration frequency regions may be identified that contribute to targeted sound frequencies, which in some cases can be desirable or undesirable. While three vibration frequency regions are depicted on each of the crown 104 and sole 106, there may exist a greater or fewer number vibration frequency regions, depending on the particular construction of the golf club head 100. In addition, the locations of the vibration frequency regions will change depending on the construction of the golf club head 100. Further, the shapes of the vibration frequency regions will differ and change as well.

As described herein, an "inherent vibration" is a vibration that results from a golf ball strike from a standard golf club head, such as golf club head 100, that does not include the stranded structures as described herein. For example, a TITLEIST 915D3 driver, available from Acushnet Company of Fairhaven, Mass., would produce a sound resulting from inherent vibrations. Similarly, the term "inherent vibration frequency region" is a vibration frequency region of a standard golf club that is unmodified, e.g., that is not altered in accordance with the teachings herein. A particular inherent vibration frequency region produces a particular inherent vibration frequency. A "known inherent vibration frequency" is a measured, predetermined, estimated, calculated, or otherwise derived vibration frequency of a golf club head without the stranded structures described herein. Vibration durations may also be similarly described.

The inherent vibration frequencies of the golf club head 100 can be modified by altering the construction of the golf club head 100. For example, an inherent vibration frequency region that contributes to an undesirable sound frequency can be identified and subsequently modified as described herein to reduce or eliminate that undesirable frequency. In an example, the modification includes forming a cantilevered or beam strand in the identified vibration frequency region and filling a gap proximate to the strand with a polymer or other material so as to alter a flexibility and therefore the frequency thereof. As an example, an inherent frequency region that contributes to an undesirable frequency is identified, and a strand is then cut, punched, formed, or otherwise incorporated into the golf club head at a location corresponding to the identified inherent vibration frequency region. In some examples, the duration of the emitted sound frequency may also be reduced. Depending on the particular construction of the cantilevered strand, the emitted sound frequency from the location of the cantilevered strand may be reduced to a level that is difficult to be heard by the human ear, such as a frequency below about 200 Hz.

Figure 2A:
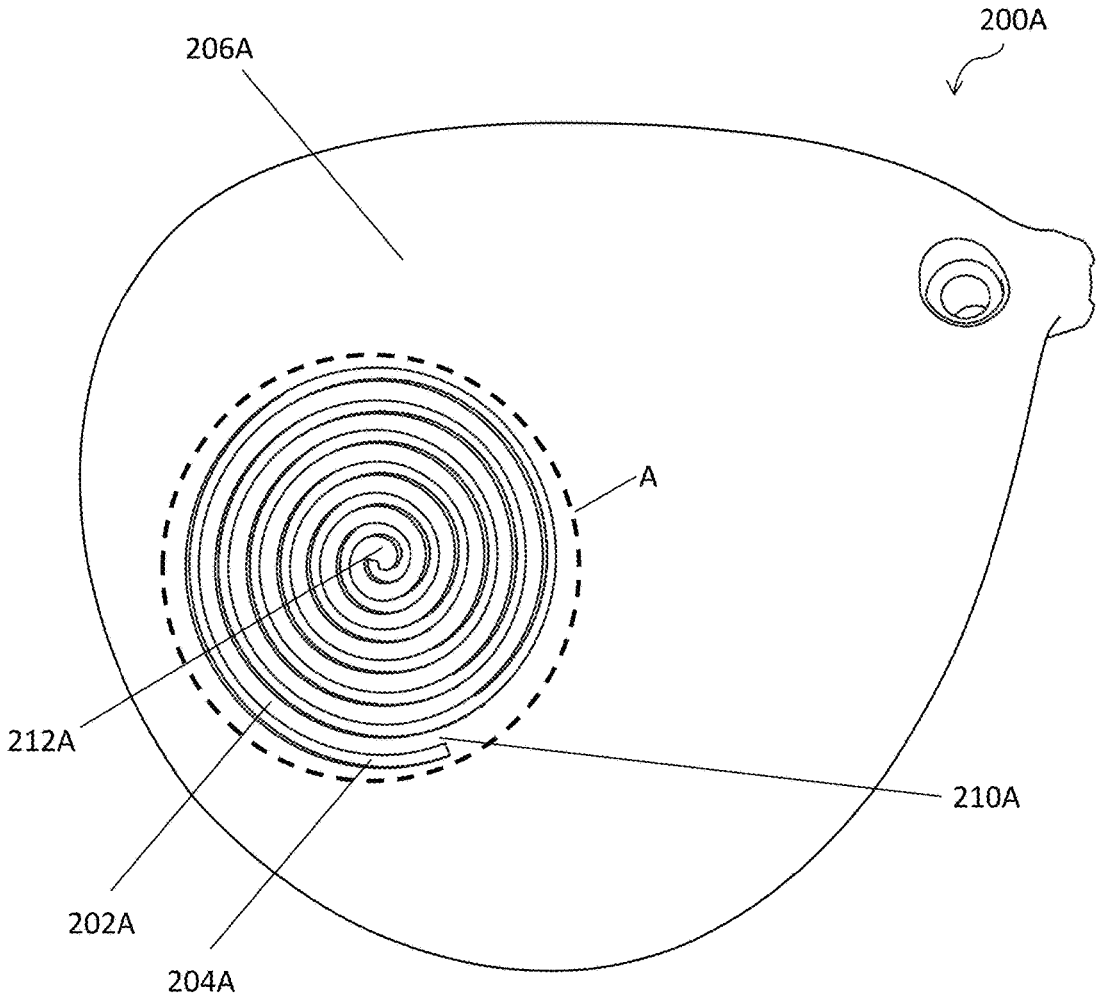
FIG. 2A depicts a bottom view of a golf club head having a spiral cantilevered strand in accordance with an example of the present technology.

FIG. 2A depicts a bottom view of a golf club head 200A having a cantilevered strand 202A defined by a sole 206A of the golf club head 200A. The cantilevered strand 202A is depicted as being perfectly spiral, but may also be substantially spiral-shaped. The cantilevered strand 202A may be manufactured by making a cut in the sole 206A that results in an unsupported section 212A of the cantilevered strand 202A being separated from remainder of the sole 206A by a gap 204A, while the supported end 210A remains connected to the sole 206. In examples, the gap 204A is a through-hole from an outer surface of the sole 206A to an inner surface of the sole 206A. In some examples where the club head 200A is substantially hollow, the through-hole or gap 204A is in communication with an interior void therein. Thus, the gap 204A forms a through-hole into the interior void of the golf club head 200A. In the example shown in FIG. 2A, the gap 204A is substantially the same shape and width as the cantilevered strand 202A. In one example, the length of the cantilevered strand 202A is approximately 530 mm and the approximate surface area A containing the spiral strand is 1963 $mm^2$. In that example, the cantilevered strand 202A has a diameter of approximately 50 mm and the surface area of the gap 204A is approximately 847 $mm^2$. In an example, the surface area A containing the cantilevered strand 202A is approximately 10% of the entire surface area of the sole 206A. The ratio of the surface area A of the cantilevered strand 202A to the entire sole or crown may be referred to herein as the "strand to sole ratio" or the "strand to crown ratio," respectively. Such ratios may be about 1:5, about 1:10, about 1:15, or about 1:20 as required or desired for particular applications. In addition, the length of the cantilevered strand 202A may be substantially greater than the width of the cantilevered strand, as depicted in FIG. 2A.

Figure 2B:
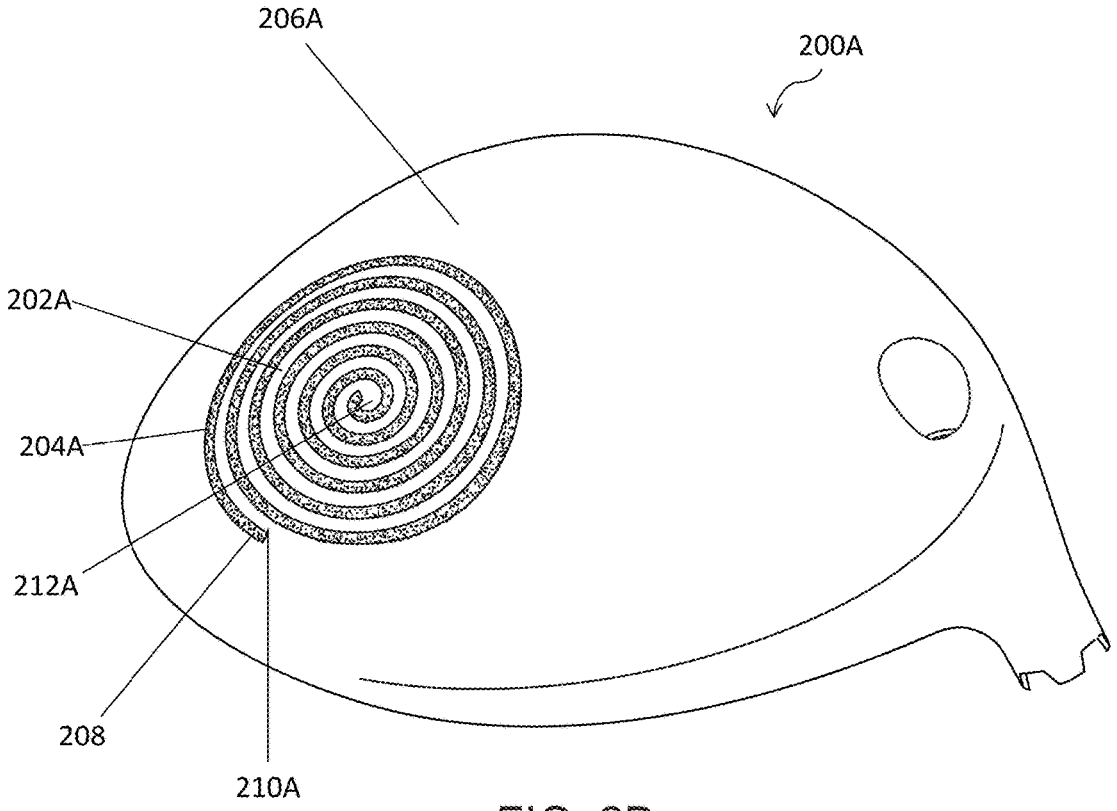
FIG. 2B depicts a perspective view of a golf club head having a spiral cantilevered strand filled with a flexible polymer in accordance with an example of the present technology.

As shown in FIG. 2B, the gap 204A is filled with a flexible polymer material 208. The flexible polymer material 208 is a material that has a stiffness substantially less than that of the rigid sole material. In one example, the Shore hardness of the flexible polymer material is within the range of approximately A20 to D90. For instance, the flexible polymer may be an acrylic epoxy, such as 3M brand SCOTCH WELD DP810 acrylic adhesive available from the 3M Company of St. Paul, Minn. Other flexible materials include urethanes, polyurethanes, ionomers, elastomers, silicones, rubbers, and other similar materials. Different types of the flexible polymer materials may be selected to further alter the sound emitted from the golf club head 200A. By filling the gap 204A with flexible polymer material 208, external objects are prevented from entering the interior void of the golf club head 200A via the gap 204A. Further, the flexible polymer 208 absorbs a portion of the vibrational energy of the cantilevered strand 202A when the golf club head 200A strikes a golf ball. The flexible polymer material 208 also limits the displacement of the spiral cantilevered strand 202A upon the club head 200A striking a golf ball. The flexible polymer material 208 may be applied in a liquid or semi-liquid state, then shaped to match the contour of the surface, after or during hardening. In other examples, the flexible polymer material 208 may be in the form of a solid polymer plug shaped so as to match the shape and contour of the gap 204A. As such, the solid polymer plug may be inserted into the gap 204A during the manufacturing of the golf club head 200A.

Figure 2C:
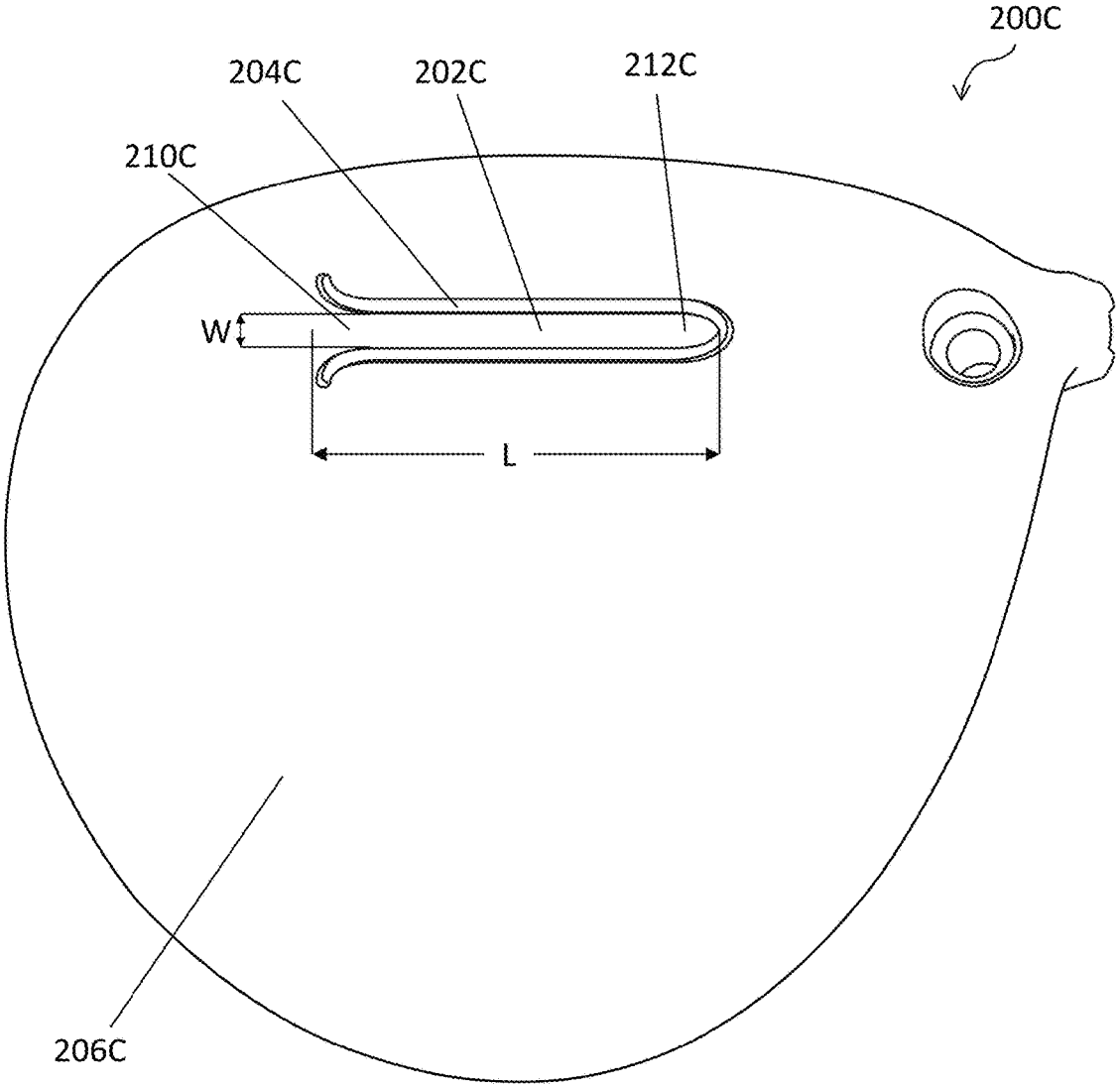
FIG. 2C depicts a bottom view of a golf club head having an elongated cantilevered strand in accordance with an example of the present technology.

FIG. 2C depicts a bottom view of a golf club head 200C having a cantilevered strand 202C defined by the sole 206C of golf club head 200C. In the example depicted in FIG. 2C, the cantilevered strand 202C has an elongate shape. The elongate cantilevered strand 202C has a supported end 210C connected to the remainder of the sole 206C and an unsupported section 212C that it separated from the remainder of the sole 206C by a gap 204C. The gap 204C may also be filled with a flexible polymer material, such as the flexible polymer material 208, as described above.

The elongate cantilevered strand 202C may be described as having a length L and a width W, and having a length-to-width ratio. In examples, the length L may be substantially longer than the width W. Depending on the particular application, length-to-width ratios of 2:1 to ratios exceeding 1000:1 may be used. Stranded structures having higher length-to-width ratios will generally exhibit lower acoustic frequencies when the golf club head 200C strikes a golf ball. The elongate cantilevered strand 202C may also be described as having a ratio of width W and a width of the gap 204C, referred to herein as a strand-width-to-gap-width ratio. In examples, the width W of the elongate cantilevered strand 202C may be substantially the same or larger than the width of the gap 204C. Depending on the particular application, strand-width-to-gap-width ratio of 0.1:1 to 100:1 or higher may be used. Yet another potential ratio that may be used to describe the elongate strand 202C is a ratio between the width of the gap 204C and the thickness of the component, such as the sole 206C, defining the gap 204C, referred to herein as a gap-width-to-component-thickness ratio. In some examples, gap-width-to-component-thickness ratios of 0.5:1 to 5:1 may be used. While the above ratios have been discussed with reference to the elongate cantilevered strand 202C, similar ratios may be used to describe any stranded structure discussed herein, including both cantilevered and beam strands.

Figure 2D:
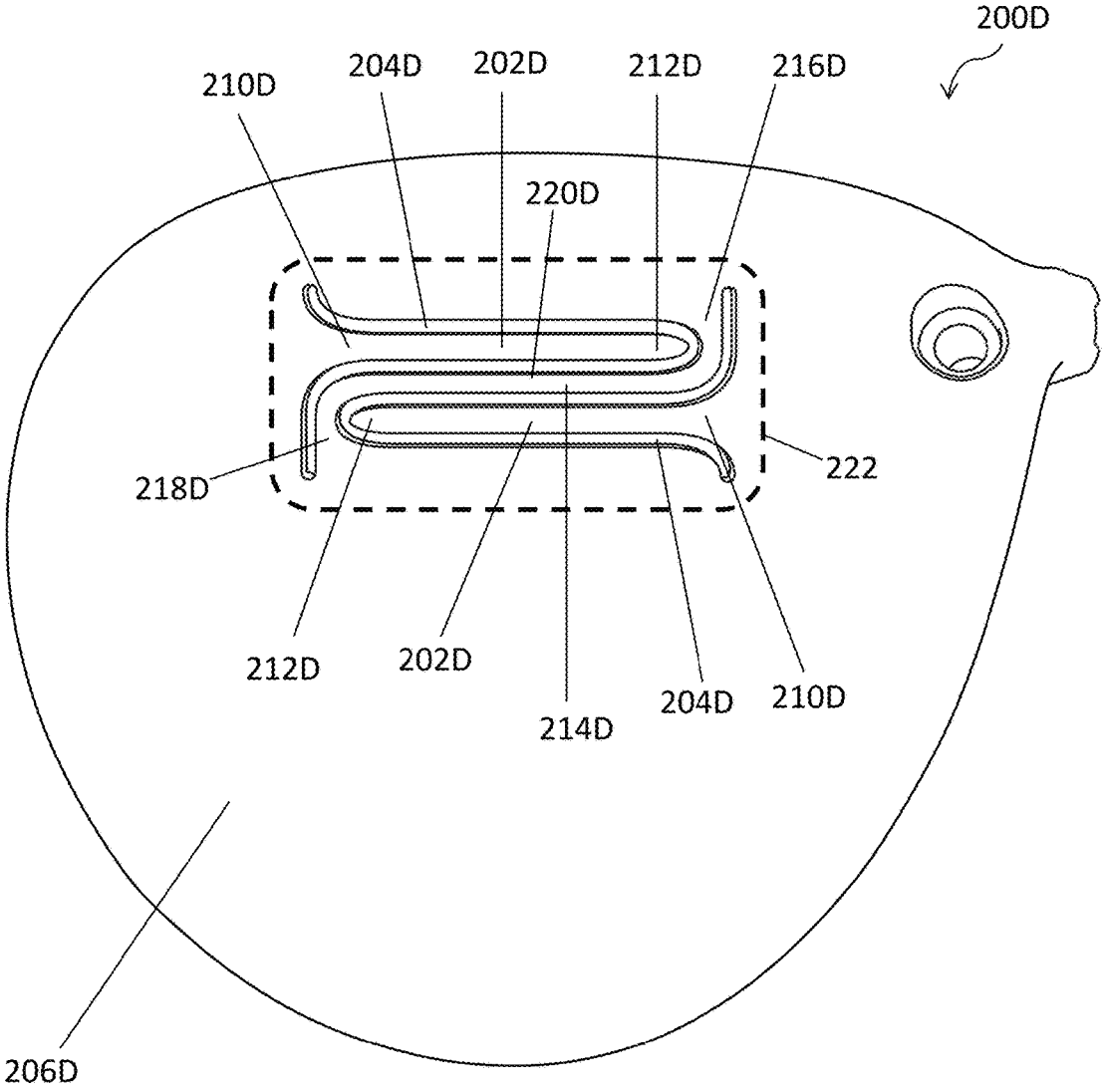
FIG. 2D depicts a bottom view of a golf club head having two elongated cantilevered strands and a beam strand in accordance with an example of the present technology.

FIG. 2D depicts a bottom view of a golf club head 200D having a plurality of cantilevered strands 202D defined by the sole 206D of the golf club head 200D. In the example depicted in FIG. 2D, both the cantilevered strands 202D have an elongate shape. Each of the elongate cantilevered strands 202D have a supported end 210D connected to the remainder of the sole 206D and an unsupported section 212D separated from the remainder of the sole 206D by gaps 204D. The gaps 204D may be filled with a flexible polymer material, such as flexible polymer material 208, as described above.

A beam strand 214D is also defined by the sole 206D. The beam strand 214D is connected to the sole 206D on a first supported end 216D and second supported end 218D. The beam strand 214D has an unsupported center portion 220D.

The cantilevered strands 202D and the beam strand 214D depicted in FIG. 2 may be incorporated into the sole 206D by an insert 222. The insert 222 may be formed separately from the sole 206D to include the cantilevered strands 202D and the beam strand 214D. The insert 222 may then be incorporated into the sole 206D. For example, a hole may be cut or otherwise formed in the sole 206D such that the hole is able to accept the insert 222. The insert 222 may then be attached to the sole 206D via any attachment methods known to those having skill in the art, such as welding or adhesives.

Figure 2E:
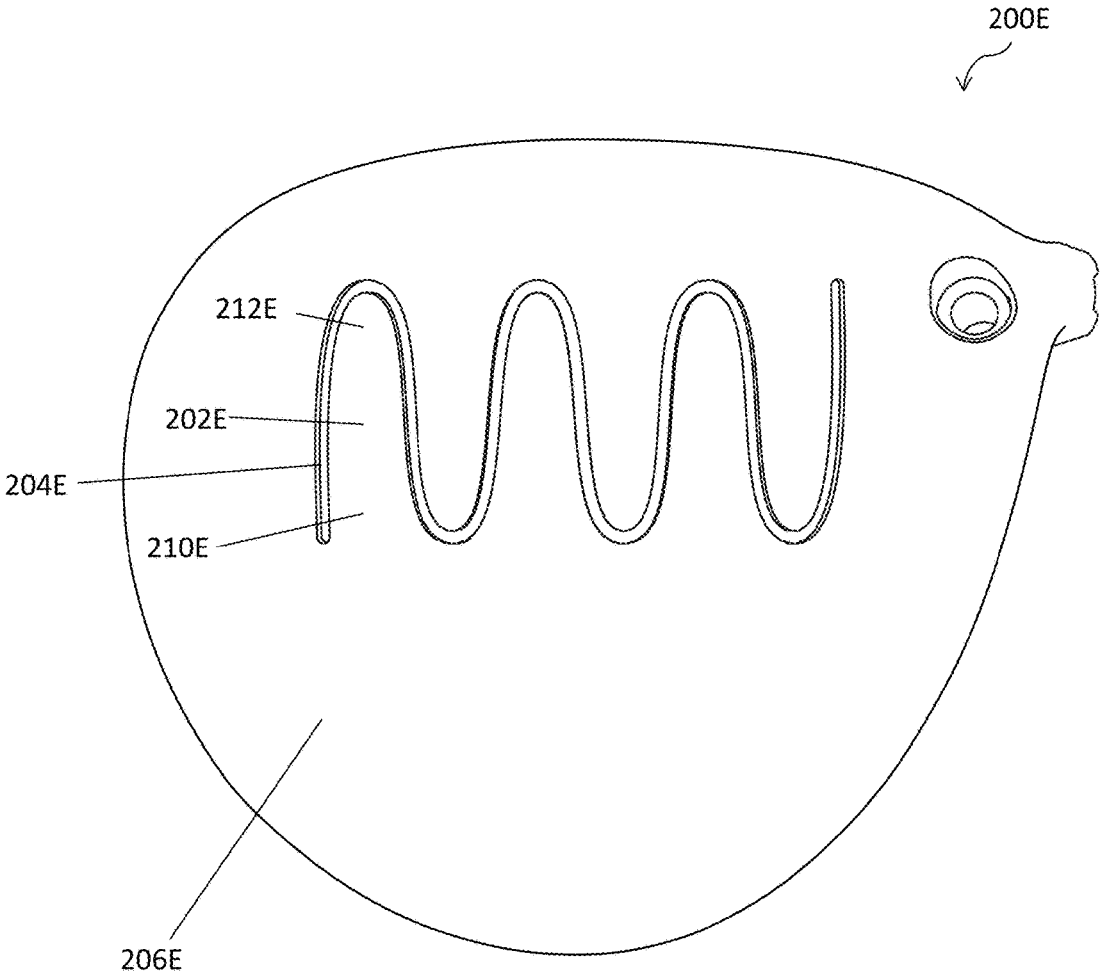
FIG. 2E depicts a bottom view of a golf club head having a plurality of elongated cantilevered strands in accordance with another example of the present technology.

FIG. 2E depicts a bottom view of a golf club head 200E having multiple elongate cantilevered strands 202E defined by the sole 206E of the golf club head 200E. The multiple elongate cantilevered strands 202E may be manufactured by making a single cut that results in a gap 204E. As shown in FIG. 2E, there are six elongate cantilevered strands 202E. Each of the elongate cantilevered strands 202E has a supported end 210E connected to the remainder of the sole 206E and an unsupported section 212E separated from the remainder of the sole 206E by the gap 204E. The gap 204E may be filled with a flexible polymer material, such as flexible polymer material 208, as described above.

Figure 2F:
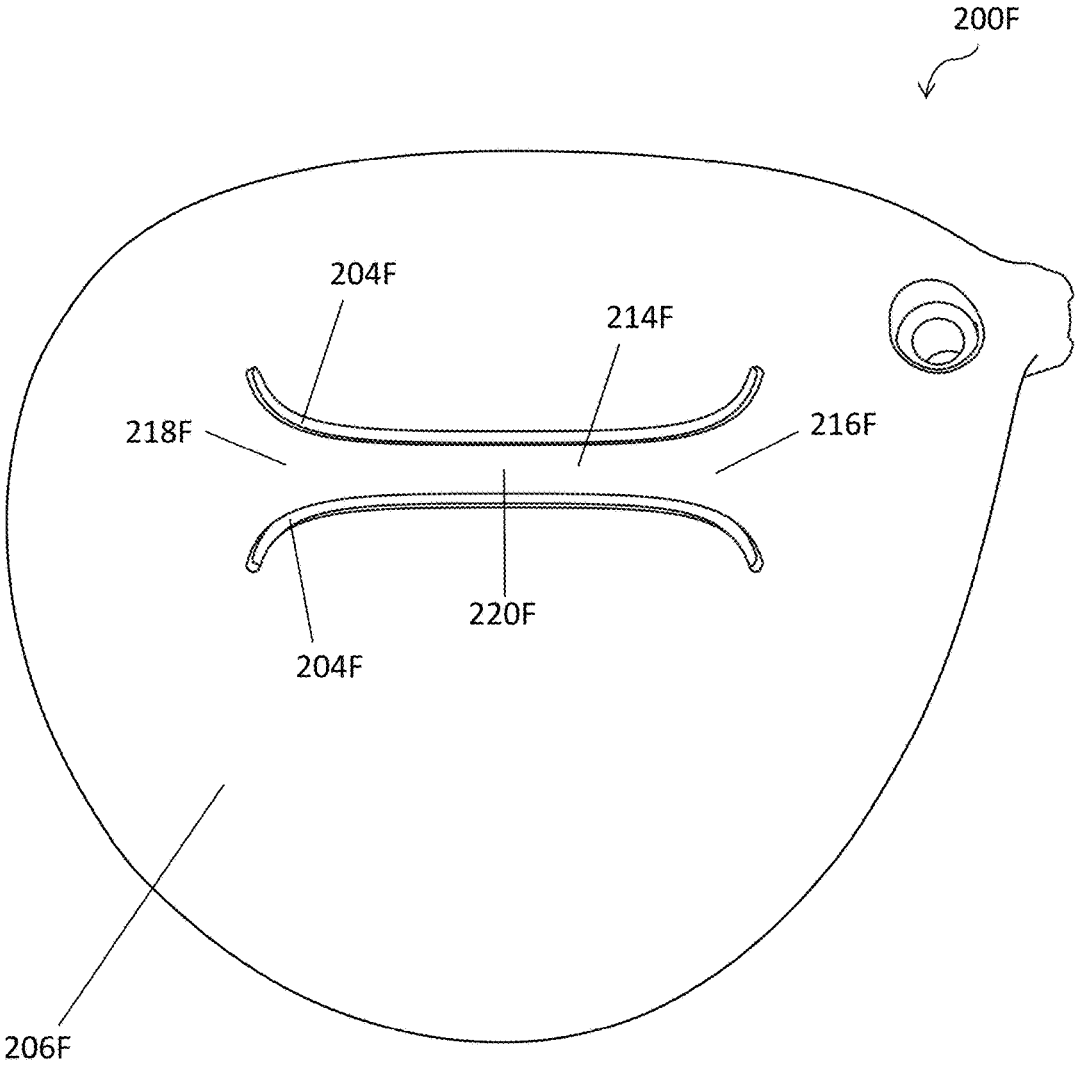
FIG. 2F depicts a bottom view of a golf club head having a beam strand in accordance with an example of the present technology.

FIG. 2F depicts a bottom view of a golf club head 200F having a beam strand 214F defined by the sole 206F of the golf club head 200F. The beam strand 214F may be manufactured by making two cuts resulting in gaps 204F. The beam strand 214F has a first supported end 216F, an unsupported center portion 220F, and second supported end 218F. The gaps 204F may be filled with a flexible polymer material, such as flexible polymer material 208, as described above. While golf club head 200F is depicted as having only one beam strand 214F, it should be understood that golf club head 200F may include multiple beam stands, including beam strands that are separated from one another and/or beam strands that intersect one another, such as to form a cross-shaped strand or an x-shaped strand, along with other configurations. In addition to the cantilevered and beam configurations depicted herein, other configurations are contemplated.

Figure 3:
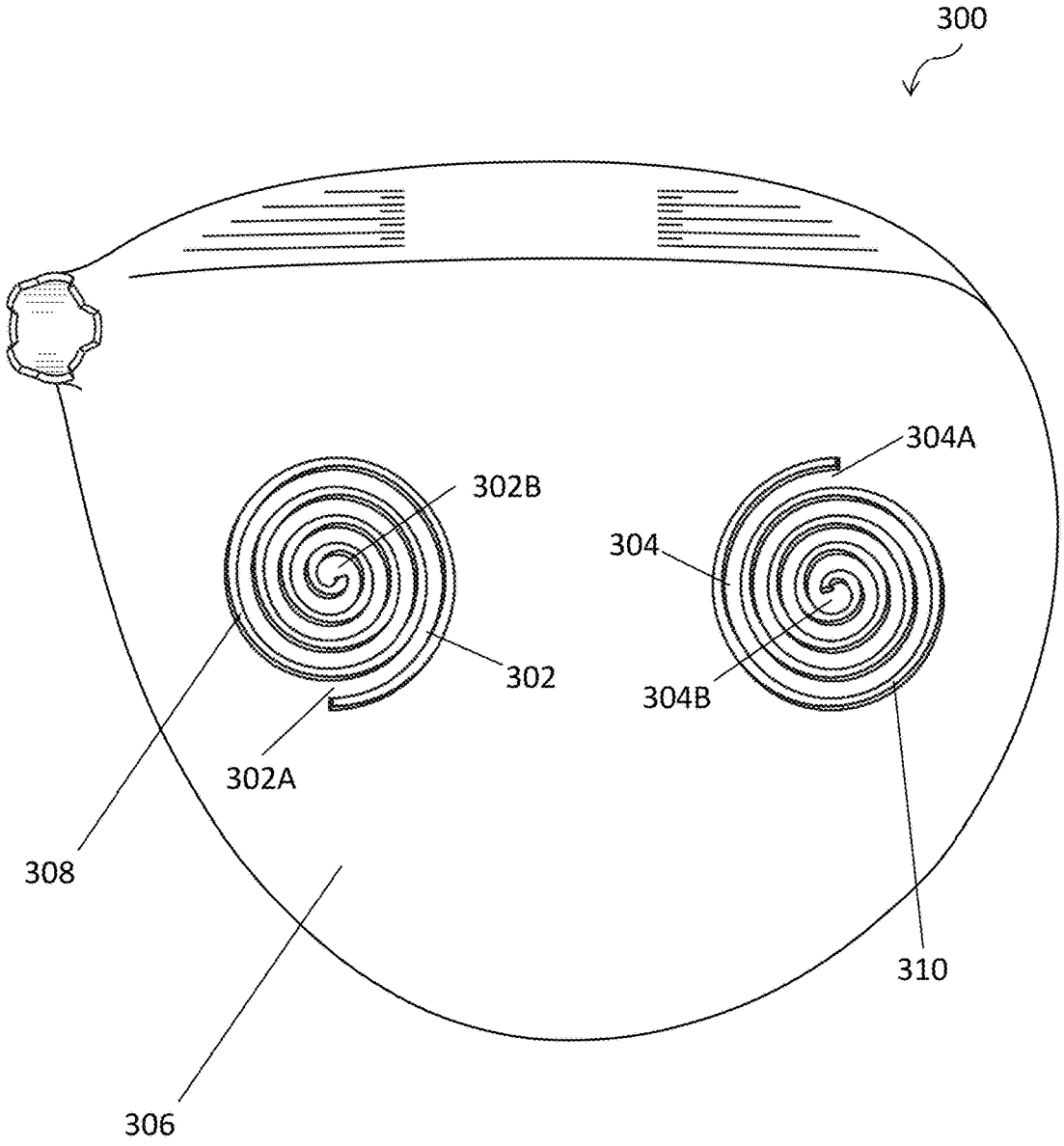
FIG. 3 depicts a top view of a golf club head having two spiral cantilevered strands in accordance with an example of the present technology.

FIG. 3 depicts an example of a golf club head 300 having a first spiral cantilevered strand 302 and a second spiral cantilevered strand 304 defined by the crown 306 of golf club head 300. The first spiral cantilevered strand 302 and the second spiral cantilevered strand 304 may be manufactured in a similar fashion as the spiral cantilevered strand 202 depicted in FIGS. 2A-2B. For example, the first spiral cantilevered strand 302 and the second spiral cantilevered strand 304 may be manufactured by making two cuts, forming a first gap 308 and a second gap 310. The first spiral cantilevered strand 302 has a supported end 302A connected to the remainder of the crown 306 and an unsupported section 302B separated from the remainder of the crown 306 by a gap 308. The second spiral cantilevered strand 304 has a supported end 304A connected to the remainder of the crown 306 and an unsupported section 306B separated from the remainder of the crown 306 by a gap 310. The gaps 308, 310 may be filled with a flexible polymer material, such as flexible polymer material 208, as described above.

While the cantilevered and beam strands of FIGS. 2A-2F and FIG. 3 have been depicted in particular locations or having particular shapes, it should be understood that the locations and shapes of the strands will differ depending on the particular application and the particular vibration frequency regions. For example, multiple strands may exist on both the crown and sole of a golf club, depending on the particular needs of the application. For instance, the strands depicted in FIGS. 2A-2F as being incorporated into the sole may also be incorporated into the crown. Similarly, the strands depicted in FIG. 3 as being incorporated into the crown may also be incorporated into the sole.

Figure 4:
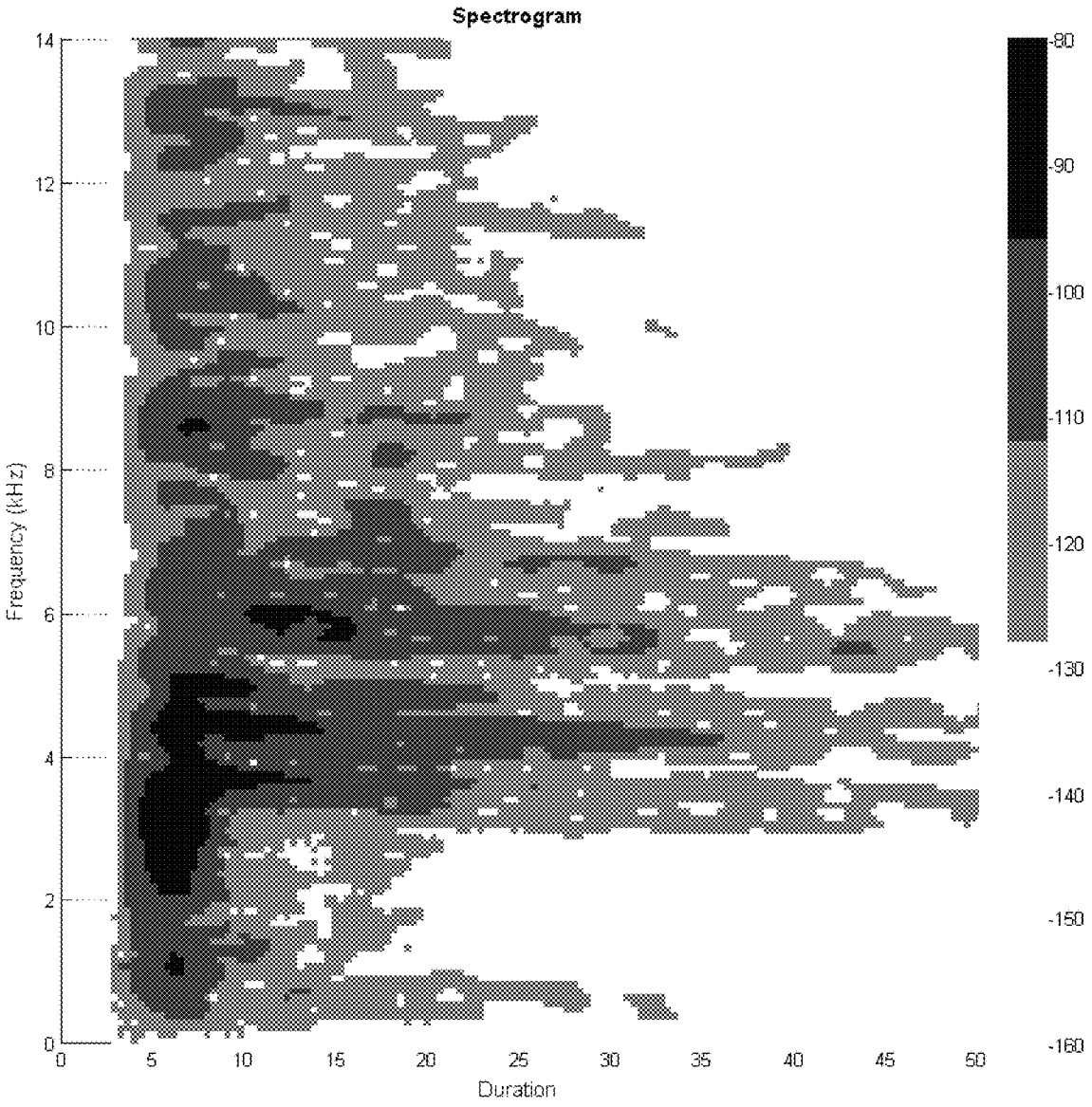
FIG. 4 depicts an acoustic spectrogram generated from sound captured from a standard golf club head when striking a golf ball.

FIG. 4 depicts an acoustic spectrogram generated from sound captured from a standard golf club striking a golf ball. For the test used to produce the results shown in FIG. 4, a TITLEIST 915 D3 production driver was used. The production driver was set to a weight of 189 grams and having 9.5 degrees of loft. The ball that was struck was a 2015 TITLEIST PROV1X golf ball available from Acushnet Company of Fairhaven, Mass. The head of golf club was moving at an average velocity of 109.3 miles per hour at the time of impact with the ball, with a potential measurement error of approximately ±0.2 miles per hour. The impact with the ball resulted in the ball leaving the club face with a ball speed of 158.2 miles per hour, with a potential measurement error of approximately ±0.3 miles per hour.

The acoustic spectrogram in FIG. 4 represents the frequency, in kHz, of the captured sound on the y-axis and the duration, in milliseconds, of the sound on the x-axis. Additionally, the color of the data represented on the acoustic spectrogram represents the relative intensity of the sound at the designated frequency in dB/Hz. As shown by the key, the darker the shade, the more intense the sound.

As shown in the acoustic spectrogram in FIG. 4, there are highly intense portions of sound occurring within the band of approximately 2-5 kHz. Within that band, there are peaks of longer duration frequency bands centering on approximately 5 kHz, 4.5 kHz, and 3.8 kHz. In addition, another small, high-intensity portion is seen at approximately 1.5 kHz. Additional characteristics of the sound may also be determined from the acoustic spectrogram in FIG. 4.

Figure 5:
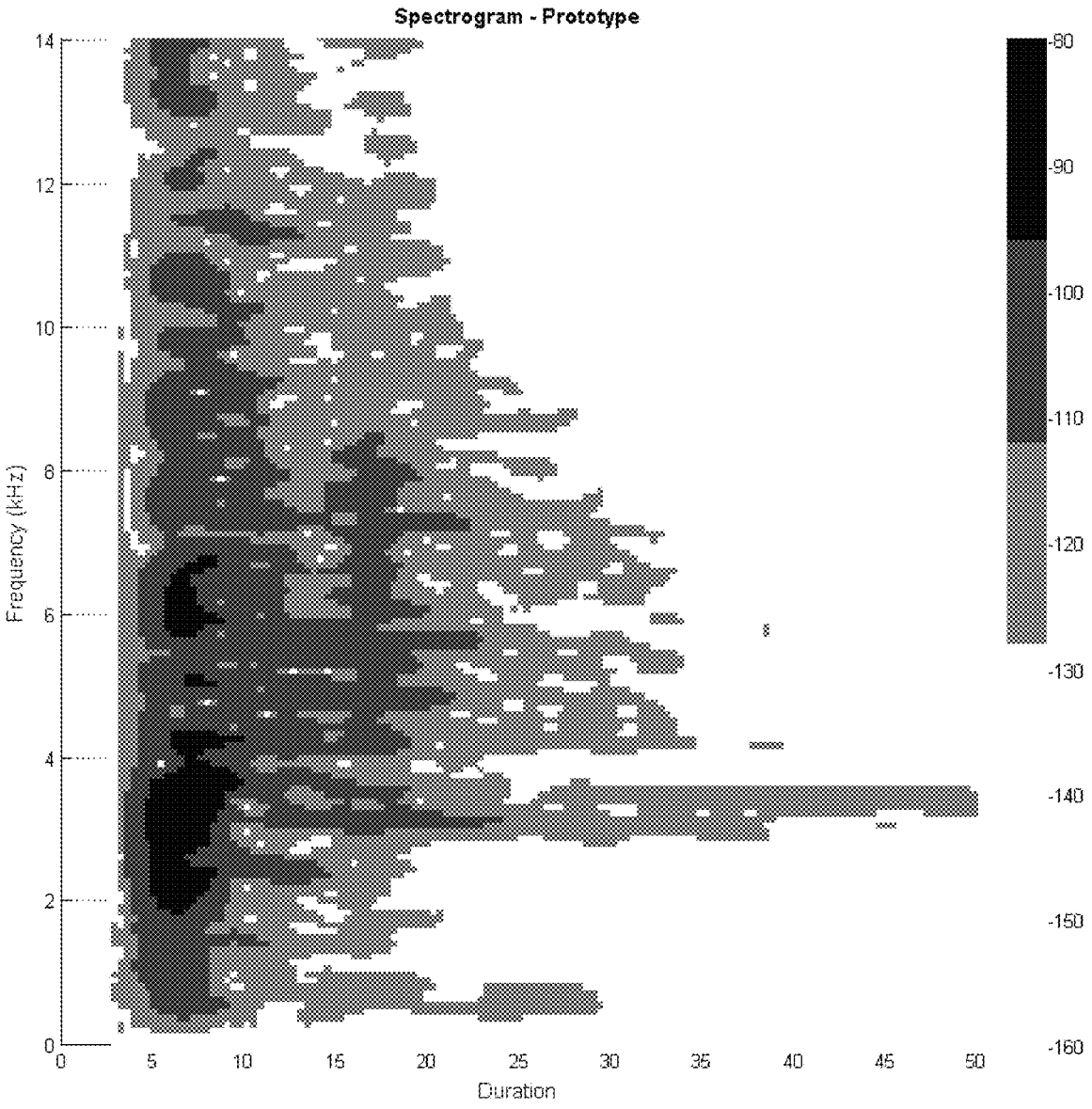
FIG. 5 depicts an acoustic spectrogram generated from sound captured from a golf club head having a spiral cantilevered strand in the sole of the golf club head, when striking a golf ball.

FIG. 5 depicts an acoustic spectrogram generated from sound captured from a golf club having a spiral cantilevered strand in the sole of the golf club. The spiral cantilevered strand was cut into a TITLEIST 915 D3 production driver set at a weight of 189 grams and having 9.5 degrees of loft. The shaft used in the test was the same shaft used in the test that produced the spectrogram in FIG. 4. The spiral cantilevered strand had a substantially similar construction to the spiral cantilevered strand depicted in FIG. 2B. The length of the cantilevered strand was approximately 530 mm and the approximate surface area containing the spiral strand was 1963 $mm^2$. The cantilevered strand had a diameter of approximately 50 mm. The surface area containing the cantilevered strand was approximately 10% of the entire surface area of the sole. The gap around the cantilevered strand was filled with a 3M brand SCOTCH WELD DP810 acrylic adhesive available from the 3M Company of St. Paul, Minn. The ball struck was a 2015 TITLEIST PROV1X. The head of golf club was moving at an average velocity of 109.1 miles per hour at the time of impact with the ball, with a potential measurement error of approximately ±0.2 miles per hour. The impact with the ball resulted in the ball leaving the club face with a ball speed of 157.9 miles per hour, with a potential measurement error of approximately ±0.3 miles per hour.

As shown in the acoustic spectrogram in FIG. 5, the duration of many of the frequency bands showing high intensity have decreased. In addition, the high-intensity bands have also shifted downward to a lower frequency. The high intensity portion at approximately 1.5 kHz shown in FIG. 4 is also no longer present in the spectrogram of FIG. 5.

Based on further analysis the results of the production driver and the driver with the spiral cantilevered strand, it was determined that the total sound pressure level produced from the driver with spiral cantilevered strand was reduced by approximately 1.7±0.2 dB. For reference, a 10 dB reduction would be perceived by the human ear as about half as loud. Because both the head speed and ball speed were within the measurement error, as discussed above, approximately equal energy was transferred in each collision. Therefore, the observed reduction in sound pressure is most likely due to the spiral cantilevered strand structure being incorporated into the driver. Additional analysis showed that a club having a spiral cantilevered strand without polymer filling in the gap produced a first mode of vibration around 1 Hz. A club having spiral cantilevered strand with a polymer filler produced a first mode of vibration around 890 Hz. As another example, a club having multiple beam strands produced a first mode around 1.4 kHz.

Figure 6:
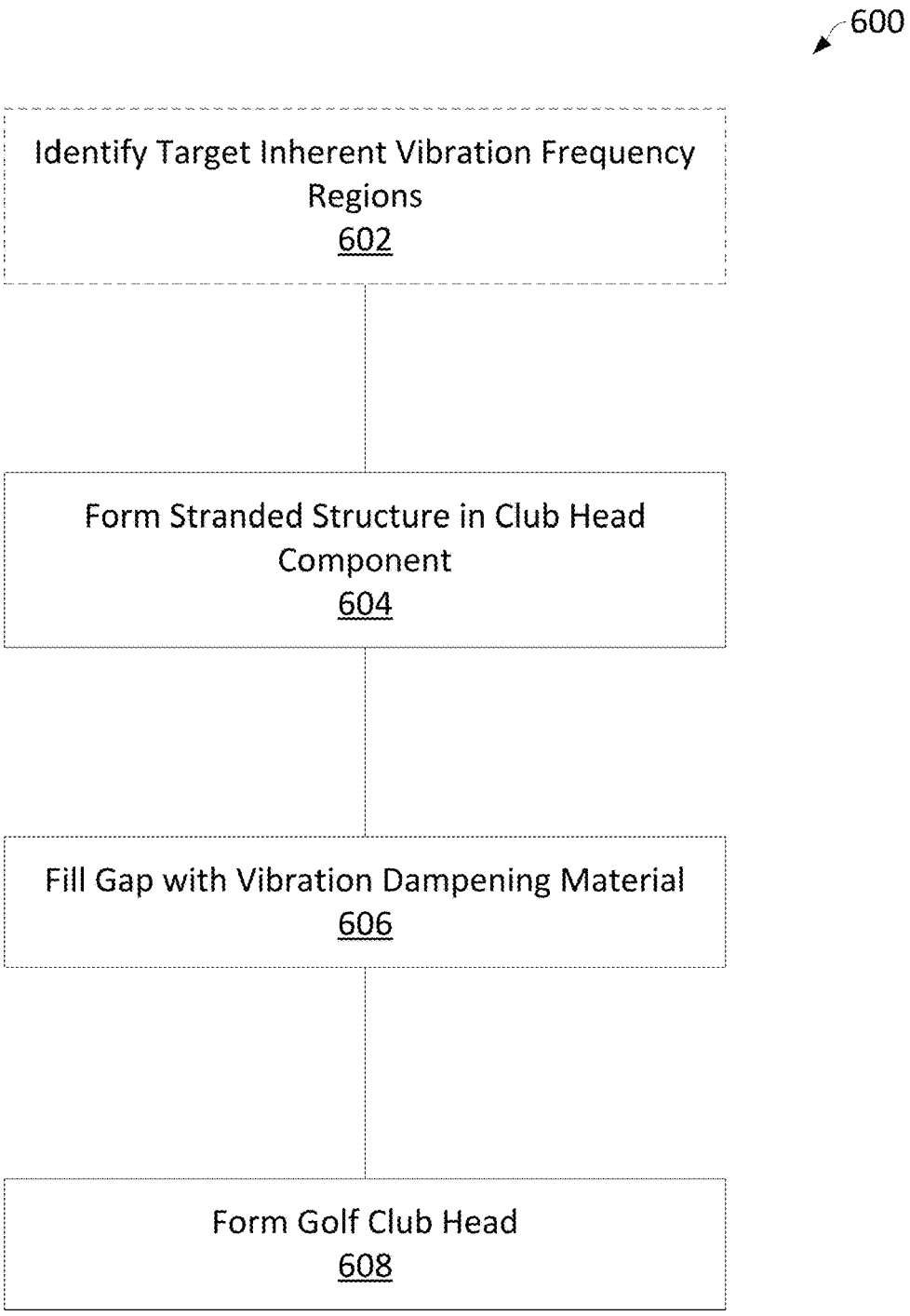
FIG. 6 depicts an example method for manufacturing a golf club head in accordance with the present technology.

FIG. 6 depicts an example method 600 for manufacturing a golf club head in accordance with the present technology. FIG. 6 begins at optional operation 602 where targeted vibration frequency regions of a component of a standard golf club head are identified. In an example, this may be a targeted vibration frequency region producing an undesirable frequency. Such identification may be accomplished via acoustic and optical measurement techniques, as discussed above and understood by those having skill in the art. For example, vibration frequency regions that produce a sound primarily within the range of 300 Hz to 3 kHz may be considered to be undesirable. Other undesirable frequencies may be frequencies that are too high. In some examples, however, undesirable frequency regions may not be identified. In such examples, the stranded structures may still be desirable to lower the overall intensity of the sound produced by the golf club.

At operation 604 a stranded structure, such as a cantilevered strand or a beam strand, is formed in one or both of a crown or a sole of a golf club head to be manufactured. The stranded structure may be formed by cutting or punching a casted or forged sole or crown. In other examples, the stranded structure may be formed as part of the casting or forging process by incorporating the stranded structure into a mold. In yet another example, the stranded structure may be added as an insert to the crown or the sole. For example, the crown or the sole may be manufactured with a void for which an insert including the stranded structure would be placed.

At operation 606, the gap or gaps surrounding the stranded structure is filled with a dampening material, such as a flexible polymer as discussed above. In examples where the stranded structure is formed in the crown or the sole as an insert, the gap or gaps may be filled prior to placing the insert into the crown or the sole. For instance, a hole may be cut into or otherwise formed in the crown or sole of the golf club head. The hole is configured to accept an insert having the structures described herein incorporated into the insert. The insert may be attached to the crown or sole via any attachment means, such as welding or adhesives. At operation 608, the golf club head is formed with the modified crown and/or sole. In some examples, the golf club head may be formed prior to the stranded structure being formed into the crown or sole. That is, the stranded structure may be formed by cutting or punching the crown or sole even after the golf club head has been formed. In such embodiments, a traditional golf club head could be modified post-manufacturing to include a stranded structure.

Although specific embodiments and aspects were described herein and specific examples were provided, the scope of the invention is not limited to those specific embodiments and examples. One skilled in the art will recognize other embodiments or improvements that are within the scope and spirit of the present invention. Therefore, the specific structure, acts, or media are disclosed only as illustrative embodiments. The scope of the invention is defined by the following claims and any equivalents therein.

The invention claimed is:

1. A golf club head comprising:

a crown;

a club face connected to the crown; and a sole connected to and disposed opposite the crown, wherein the crown, the club face, and the sole at least partially define an interior void, and wherein at least one of the crown and the sole define:

at least one stranded structure having an unsupported section and at least one supported end, wherein the at least one stranded structure is an elongated cantilevered structure or a beam structure, wherein the unsupported section of the at least one stranded structure is separated from at least one of the crown and the sole by a through-hole and the at least one supported end is fixed to the at least one of the crown and the sole, and wherein the through-hole is filled with a flexible polymer.

2. The golf club head of claim 1, wherein the at least one stranded structure is the elongated cantilevered structure.

3. The golf club head of claim 2, wherein the flexible polymer comprises at least one of: an acrylic epoxy, a urethane, a polyurethane, an ionomer, an elastomer, a silicone, and a rubber.

4. The golf club head of claim 1, wherein the at least one stranded structure is cantilevered and substantially spiral.

5. The golf club head of claim 1, wherein the at least one stranded structure has a length to width ratio of at least ten.

6. The golf club head of claim 1, wherein a surface area of the at least one stranded structure is more than about 10% of the at least one of the crown and the sole.

7. The golf club head of claim 1, wherein the sole comprises a plurality of inherent vibration frequency regions, each having a known inherent frequency.

8. The golf club head of claim 7, wherein the flexible polymer is disposed so as to reduce a frequency of 2-5 kHz of at least one of the plurality of the inherent vibration frequency regions from the known inherent frequency.

9. A method for manufacturing a golf club, the method comprising:

forming a golf club head comprising a face connected to a sole and a crown so as to define an interior void;

removing material from at least one of the crown and the sole so as to form a stranded structure having an unsupported section and at least one supported end, wherein the at least one stranded structure is an elongated cantilevered structure or a beam structure, wherein the unsupported section of the stranded structure is separated from the at least one of the crown and the sole by a through-hole; and filling the through-hole with a flexible polymer.

10. The method of claim 9, further comprising identifying a portion of at least one of the crown and the sole that emits a sound frequency between 300 Hz to 3 kHz when the golf club head strikes a golf ball, and wherein the removing operation removes a part of the identified portion.

* * * * *